US005394849A

United States Patent [19]

Tomisawa

[11] Patent Number: 5,394,849

[45] Date of Patent: Mar. 7, 1995

[54] METHOD OF AND AN APPARATUS FOR CONTROLLING THE QUANTITY OF FUEL SUPPLIED TO AN INTERNAL COMBUSTION ENGINE

[75] Inventor: Naoki Tomisawa, Atsugi, Japan

[73] Assignee: Unisia Jecs Corporation, Atsugi, Japan

[21] Appl. No.: 162,696

[22] Filed: Dec. 7, 1993

[51] Int. Cl.[6] ..... F02D 41/04; F02D 41/10

[52] U.S. Cl. ..... 123/435; 123/478; 123/492

[58] Field of Search ..... 123/435, 478, 480, 488, 123/491, 492, 493

[56] References Cited

U.S. PATENT DOCUMENTS

| | | | |
|---|---|---|---|
| 4,640,251 | 2/1987 | Harada et al. | 123/492 |
| 4,887,575 | 12/1989 | Takahashi | 123/435 |
| 4,928,653 | 5/1990 | Ohkubo et al. | 123/435 |
| 4,996,960 | 3/1991 | Nishiyama et al. | 123/492 |
| 5,027,773 | 7/1991 | Shimomura et al. | 123/492 |
| 5,107,814 | 4/1992 | Nishiyama et al. | 123/435 |
| 5,107,815 | 4/1992 | Van Duyne | 123/435 |
| 5,174,261 | 12/1992 | Fujii et al. | 123/435 |

FOREIGN PATENT DOCUMENTS

| | | |
|---|---|---|
| 62-162364 | 10/1987 | Japan . |
| 1-216040 | 8/1989 | Japan . |
| 5-195840 | 8/1993 | Japan . |

*Primary Examiner*—Willis R. Wolfe

*Attorney, Agent, or Firm*—Foley & Lardner

[57] ABSTRACT

An incremental correction coefficient $K_{TW}$ is set according to the temperature Tw of cooling water of an engine and is used to incrementally correct the quantity of fuel injected into the engine. The coefficient $K_{TW}$ is adjusted according to detected surge torque. An incremental correction coefficient KACC is used during acceleration in the engine, to incrementally correct the quantity of the fuel to be injected and a decremental correction coefficient KDEC is used during deceleration in the engine, to decrementally correct the quantity of the fuel to be injected. The coefficients KACC and KDEC are adjusted according to the degree of the adjustment done on the coefficient $K_{TW}$. Not only the coefficient $K_{TW}$ based on the water temperature but also the coefficients KACC and KDEC based on the acceleration and deceleration are thus corrected to proper levels for the fuel.

12 Claims, 6 Drawing Sheets

METHOD OF AND AN APPARATUS FOR CONTROLLING THE QUANTITY OF FUEL SUPPLIED TO AN INTERNAL COMBUSTION ENGINE

BACKGROUND OF THE INVENTION

1. Field of the Invention

The present invention relates to a method of and apparatus for controlling the quantity of fuel supplied to an internal combustion engine, and particularly, to a technique of properly adjusting a fuel quantity correction level according to a change in fuel characteristics.

2. Description of the Related Art

Internal combustion engines have an electronic fuel injector. When the temperature of the engine is low, fuel from the injector is poorly atomized and adheres around a suction valve, to reduce the fuel drawn into a cylinder and thereby lean an air-fuel ratio. To prevent the adhesion of fuel and the leaning of air-fuel ratio, the fuel supply to the engine must be incrementally corrected according to the temperature of cooling water, which corresponds to the temperature of the engine. (Refer to, for example, Japanese Unexamined Utility Model Publication No. 62-162364.)

An adhesion ratio, i.e., the ratio of the fuel adhered around the suction valve to the injected fuel and an evaporation ratio, i.e., the ratio of the fuel evaporating from the adhered fuel and being drawn into the cylinder to the adhered fuel fluctuate even at the same temperature depending on the characteristics (in particular, the evaporative characteristics) of the fuel.

The leaning of air-fuel ratio may be prevented by incrementally correcting the fuel supply. The level of the incremental correction according to the water temperature is usually determined on fuel having heaviest evaporative characteristics, i.e., fuel that hardly evaporates. Accordingly, the incremental correction usually involves a large margin.

The incremental correction according to the water temperature, therefore, will be excessive for fuel having lighter evaporative characteristics, to make the air-fuel ratio rich to increase fuel consumption and deteriorate exhaust quality.

To solve this problem, the applicant of the present invention has disclosed in Japanese Unexamined Patent Publication No. 4-5846 an electronically controlled fuel supply apparatus that adjusts the level of incremental correction carried out on the supply of fuel according to the temperature of cooling water to a minimum to keep the surge torque of an engine within an allowable range.

Even if the temperature-based incremental correction is adjusted according to the characteristics of fuel, conventional incremental and decremental corrections carried out on the supply of fuel during acceleration and deceleration are based on the fuel having the heaviest evaporative characteristics. Accordingly, a change in the fuel characteristics may cause an excess or a shortage in the acceleration-or deceleration-based correction, to deteriorate operability during the acceleration or deceleration.

It is required, therefore, to adjust the acceleration-or deceleration-based correction according to the fuel characteristics, too. It is difficult, however, to speedily detect surge torque during the acceleration and deceleration. Accordingly, it is difficult to adjust the acceleration-or deceleration-based correction in the same manner as for the correction based on the temperature of cooling water.

SUMMARY OF THE INVENTION

To solve these problems, an object of the present invention is to properly adjust temperature-based incremental correction as well as acceleration- or deceleration-based correction carried out on the supply of fuel, according to the characteristics of the fuel.

Another object of the present invention is to easily and accurately adjust the temperature-based incremental correction level.

Still another object of the present invention is to properly correct the acceleration- or deceleration-based correction level in response to the adjustment done on the temperature-based incremental correction level.

In order to accomplish the objects, the present invention provides a method of and an apparatus for controlling the quantity of fuel supplied to an internal combustion engine. the method and apparatus incrementally correct the supply of fuel in response to the temperature of the engine and the acceleration of deceleration of the engine. the method and apparatus detect a parameter correlated to the instability of engine combustion, and according tot the parameter, adjust the temperature-based incremental correction level. In addition, the method and apparatus adjust the acceleration-or deceleration-based correction level according to the degree of the adjustment done on the temperature-based incremental correction level.

When the temperature-based incremental correction level is below a required level, the engine combustion is instable. Accordingly, the temperature-based incremental correction level is adjusted according to the parameter of instability to a minimum to stabilize the engine combustion. The degree of the adjustment on the temperature-based incremental correction level indicates a deviation of the fuel actually used from fuel for which the temperature-based incremental correction level has been initially set. Accordingly, the degree of the adjustment on the temperature-based incremental correction level is employable for adjusting the acceleration-or deceleration-based correction level for the fuel actually used.

The parameter correlated to the instability of engine combustion may be an internal pressure in the cylinder of the engine.

When the temperature-based incremental correction level is below the required level, the air-fuel ratio is lean to destabilize engine combustion and cause a misfire state. This state is detected as a decrease in the cylinder internal pressure during an explosion stroke.

Cylinder internal pressures may be integrated for a predetermined integral period, and the temperature-based incremental correction level may be adjusted such that a change in the integration comes close to a predetermined value.

Integrating the cylinder internal pressures eliminates the influence of noise in accurately detecting the instability of engine combustion.

The parameter correlated to the instability of engine combustion may be the evaporative characteristics of the fuel used, instead of the cylinder internal pressures.

The temperature-based incremental correction level is dependent on the evaporative characteristics of the fuel. Accordingly, the temperature-based incremental correction level may be adjusted according to the evaporative characteristics of the fuel actually used.

To correct the fuel supply according to acceleration or deceleration, a change in the opening of a throttle valve arranged in an intake system of the engine may be detected as a parameter corresponding to the acceleration or deceleration. This results in speedily adjusting the fuel supply.

As a decrease in the temperature-based incremental correction level becomes deeper, the acceleration- or deceleration-based correction level may be made smaller. Namely, the acceleration- or deceleration-based correction level will be reduced when fuel is light to easily evaporate and require the temperature-based incremental correction level to be smaller. Accordingly, the acceleration-or deceleration-based correction level can be adjusted to a required level of the fuel actually used.

Other objects and features of the present invention will be described hereinafter in detail by way of preferred embodiments with reference to the accompanying drawings.

DESCRIPTION OF THE PREFERRED EMBODIMENTS

A method of and an apparatus for controlling the quantity of fuel supplied to an internal combustion engine according to an embodiment of the present invention will be explained with reference to FIGS. 2 to 5.

Figure 2:
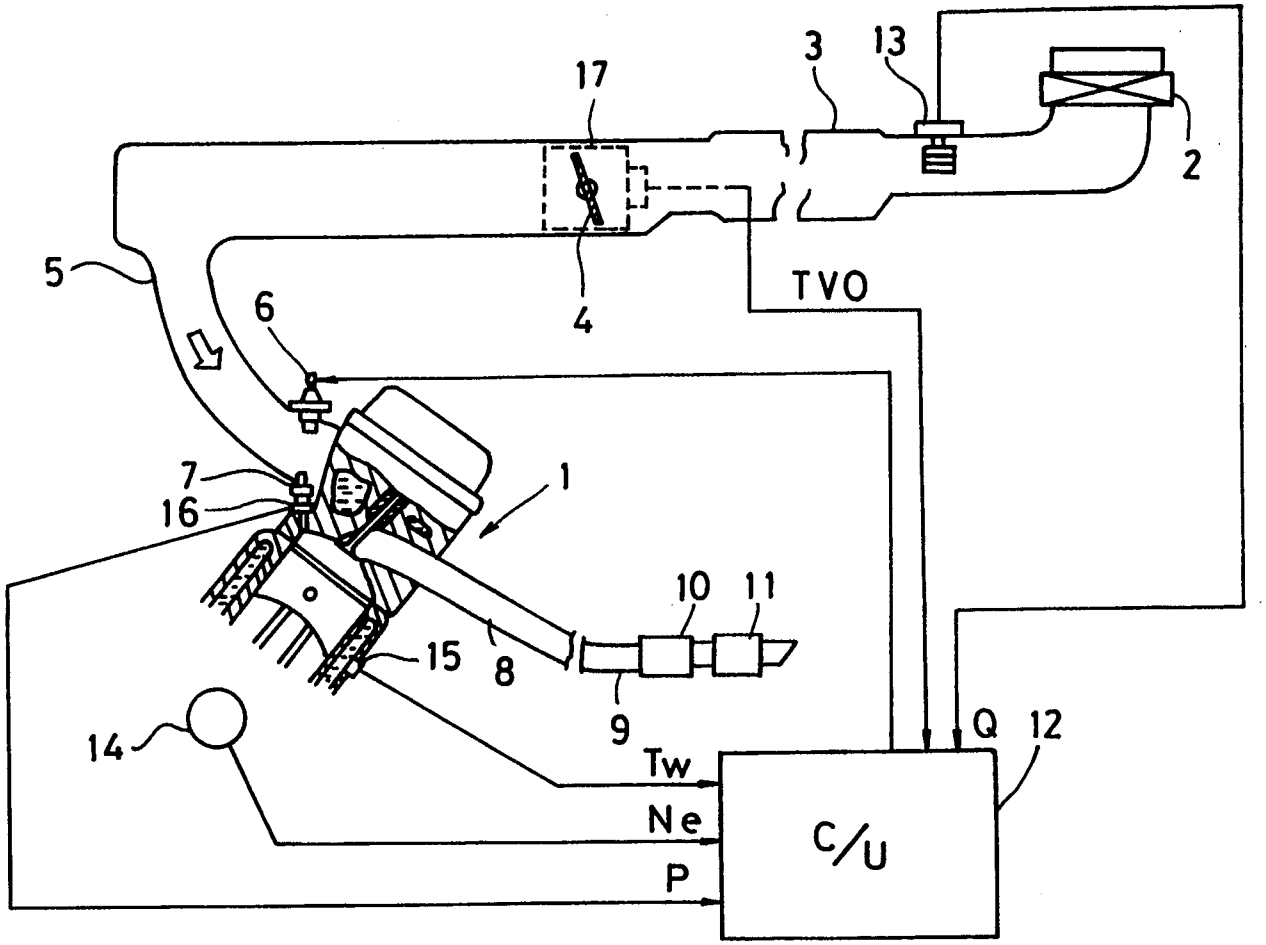
FIG. 2 is a schematic view showing a fuel supply controller according to an embodiment of the present invention.

In FIG. 2, intake air is guided into the internal combustion engine 1 through an air cleaner 2, an intake duct 3, a throttle valve 4, and an intake manifold 5. Each branch of the intake manifold 5 has a fuel injector 6 for supplying fuel to a corresponding cylinder.

The fuel injector 6 is of an electromagnetic type having a solenoid. The solenoid is energized to open the injector and de-energized to close the injector in response to a drive pulse signal provided by a control unit 12. A fuel pump (not shown) feeds fuel, and a pressure regulator adjusts the pressure of the fuel to a predetermined level. The pressure adjusted fuel is intermittently injected into the engine 1 through the injector 6.

Each combustion chamber of the engine 1 has an ignition plug 7 to ignite an air-fuel mixture. Exhaust from the engine 1 is discharged outside through an exhaust manifold 8, an exhaust duct 9, a catalyst 10, and a muffler 11.

The control unit 12 electronically controls the supply of fuel to the engine 1. The control unit 12 has a microcomputer involving a CPU, a ROM, a RAM, an A/D converter, and an I/O interface. The control unit 12 receives signals from sensors, processes the signals, and controls the pulse width of the drive pulse signal provided to the injector 6.

One of the sensors is an airflow meter 13 arranged in the intake duct 3. The airflow meter 13 provides a signal representing an intake air quantity Q supplied to the engine 1.

Another of the sensors is a crank angle sensor 14, which generates a reference angle signal REF at every reference angle positions such as every TDC and a unit angle signal POS at every one or two degrees. A period of the reference angle signal REF or the number of pulses of the unit angle signal POS for a predetermined period is measured to calculate an engine speed Ne.

Still another of the sensors is a water temperature sensor 15 for detecting the temperature Tw of cooling water in a water jacket of the engine 1. The cooling water temperature Tw serves as a parameter indicating the temperature of the engine 1. Namely, the sensor 15 corresponds to engine temperature detection means (FIG. 1) according to the present invention.

Still another of the sensors is a cylinder internal pressure sensor 16 working as a washer of the ignition plug 7, as disclosed in Japanese Unexamined Utility Model Publication No. 63-17432. the pressure sensor 16 detects a cylinder internal pressure P in a corresponding cylinder. The pressure P indicates a combustion state.

Namely, the cylinder internal pressure P serves as a parameter correlated to the instability of engine combustion. The pressure sensor 16 corresponds to combustion state detection means (FIG. 1) according to the present invention.

The pressure sensor 16 may be of the type working as the washer of the ignition plug 7, or of a type directly exposed to the inside of a combustion chamber, to detect an internal pressure as an absolute pressure.

Still another of the sensors is a throttle sensor 17 arranged at the throttle valve 4, to detect an opening TVO of the throttle valve 4. This embodiment detects acceleration or deceleration in the engine 1 according to a rate of change in the opening TVO. The throttle sensor 17 corresponds to transient operation detection means (FIG. 1) according to the present invention.

The CPU of the microcomputer incorporated in the control unit 12 executes programs stored in the ROM. The programs carry out steps shown in flowcharts of FIGS. 3 to 5 to calculate a fuel injection pulse width Ti corresponding to a required fuel quantity. A drive pulse signal having the pulse width Ti is provided to the fuel injector 6 at proper injection timing.

Figure 1:
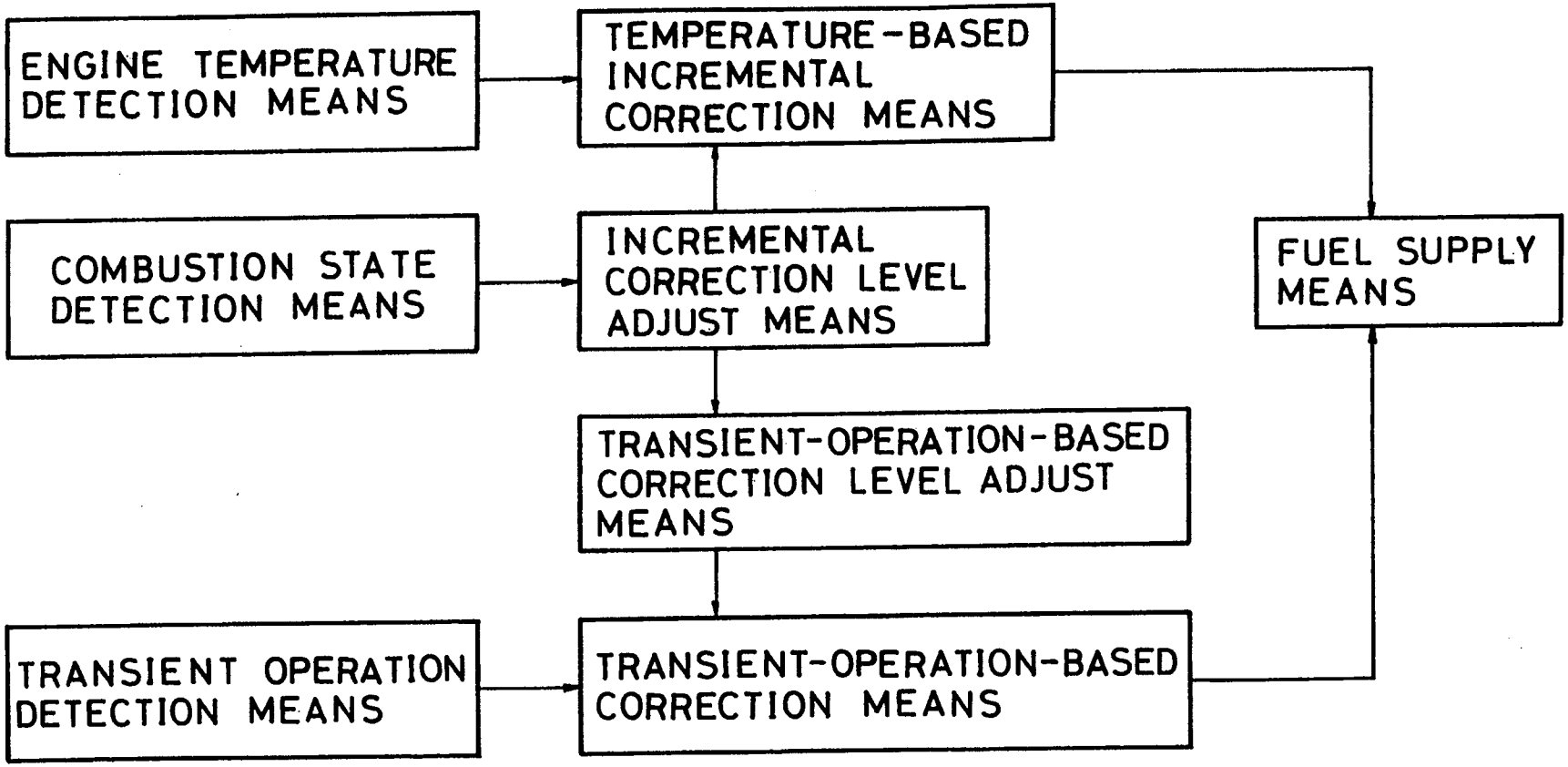
FIG. 1 is a block diagram showing a basic arrangement of the present invention disclosed in claim 1.

FIG. 1 is a block diagram showing a basic arrangement disclosed in claim 1 of the present invention. Temperature-based incremental correction means, transient-operation-based correction means, incremental correction level adjust means, and transient-operation-based correction level adjust means are achieved by software stored in the control unit 12, as shown in the flowchart of FIG. 3.

The transient operation detection means corresponds to the throttle sensor 17, the combustion state detection means corresponds to the pressure sensor 16, the engine temperature detection means corresponds to the water temperature sensor 15, and the fuel supply means corresponds to the fuel injector 6.

Figure 3A:
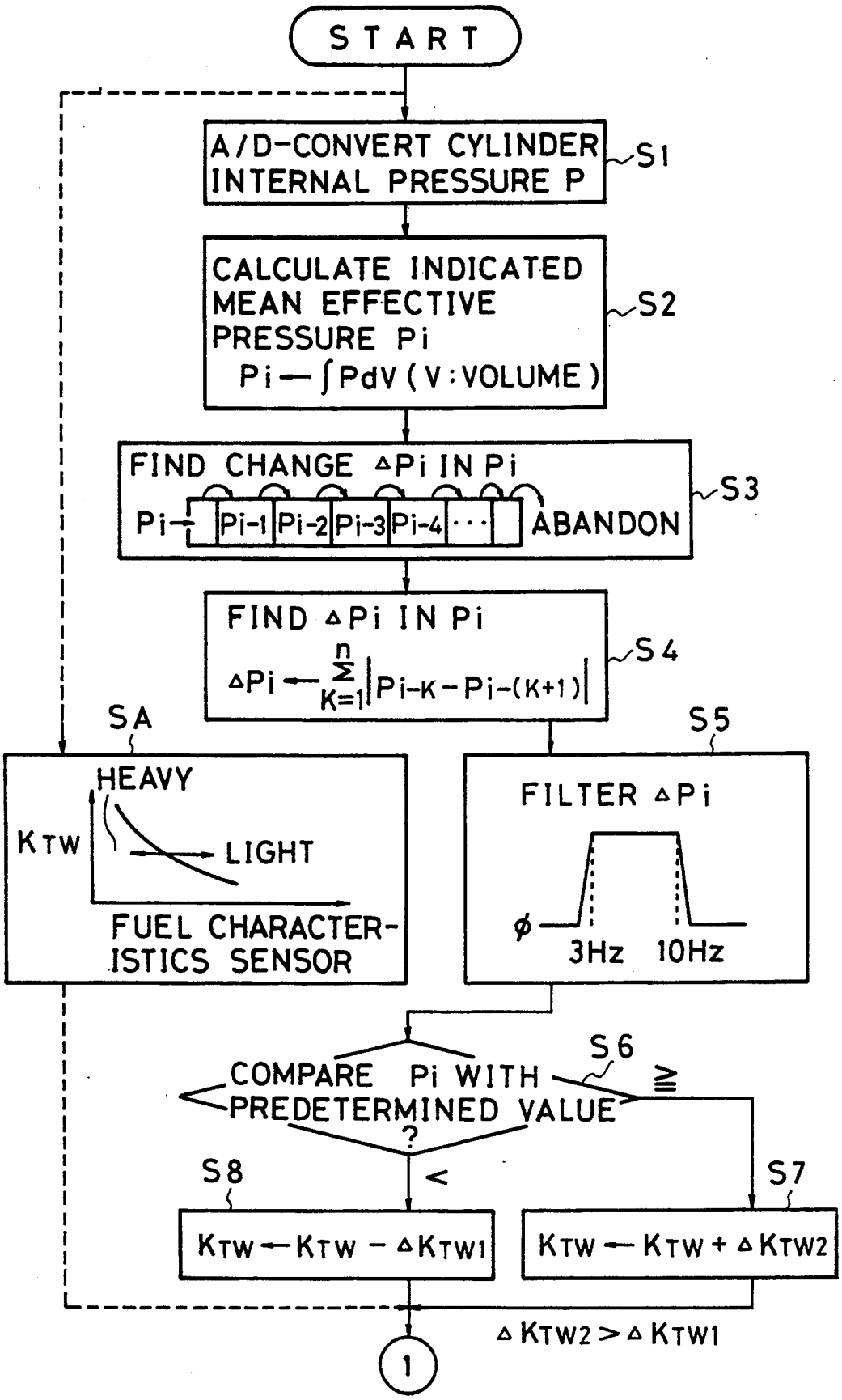
FIGS. 3A and 3B are flowcharts of steps of correcting incremental and decremental correction coefficients according to the embodiment.
Figure 3B:
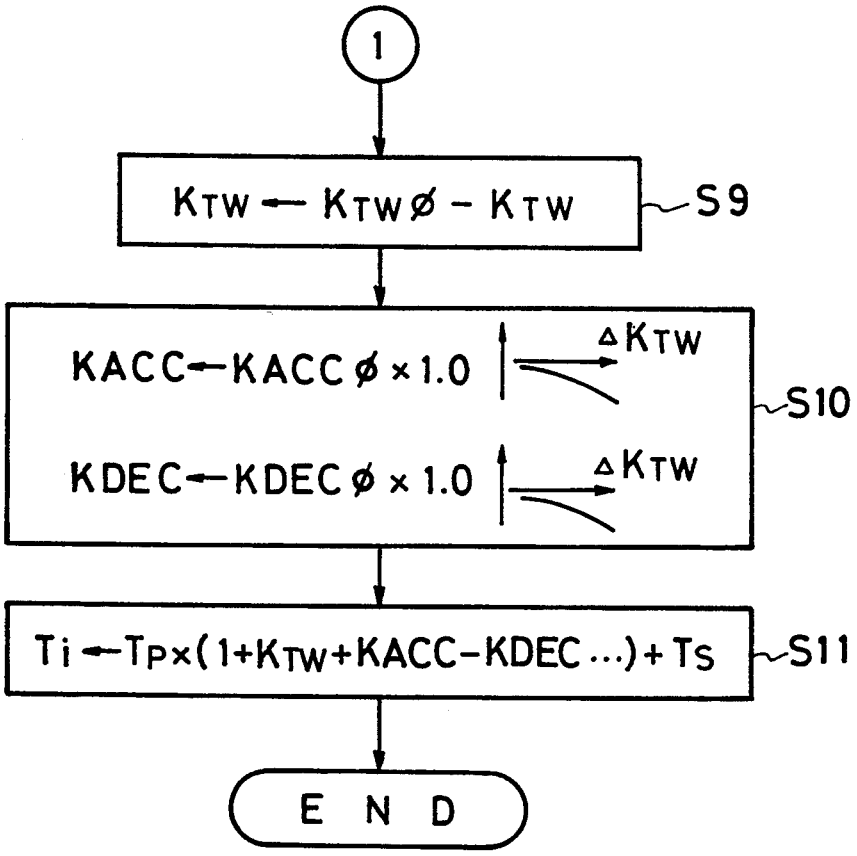

According to the flowchart of FIG. 3, step S1 receives the signal indicating the cylinder internal pressure P from the pressure sensor 16 and reads the signal after converting into a digital signal, whenever the crank angle sensor 14 provides the unit angle signal POS.

Step S2 integrates the read pressures P for a predetermined integral period and calculates an indicated mean effective pressure Pi ($=\int PdV$, where V is a cylinder volume) for a cycle of the engine 1.

Step S3 updates and stores the latest n pieces of the indicated mean effective pressures Pi in time series.

Step S4 integrates absolute deviations of the adjacent indicated means effective pressures Pi stored in time series, and the integrated value is set as a change ΔPi of the indicated mean effective pressures Pi.

Step S5 filters the change ΔPi and extracts specific frequency components (3 to 10 Hz) from the change ΔPi. The change ΔPi is proportional to a change in the output torque of the engine.

Step S6 compares a value of the extracted change ΔPi with a predetermined value.

The specific frequency components correspond to the main components of torsional oscillation of a vehicle driving system due to the change in the indicated mean effective pressures Pi. A region involving these frequency components is most sensitive to a person in the vehicle. If the levels of the specific frequency components are below a predetermined level, the person in the vehicle will not feel unpleasantness of surge. Namely, the predetermined level corresponds to an allowable surge limit.

If step S6 judges that the change ΔPi in the indicated mean effective pressures Pi is equal to or greater than the predetermined level, the fuel is lean to cause misfire. Namely, the indicated mean effective pressures Pi widely fluctuate to cause surge, and the combustion state is instable. Under this state, the person in the vehicle feels unpleasantness.

Then, step S7 incrementally adjusts an incremental correction coefficient $K_{TW}$ for the present cooling water temperature Tw by a predetermined value $\Delta K_{TW2}$, to increase the quantity of fuel to be injected. The corrected coefficient $K_{TW}$ is set as data for the present cooling water temperature Tw, and a map of correction coefficients $K_{TW}$ set depending on cooling water temperatures $K_{TW}$ is updated accordingly.

If the step S6 judges that the change ΔPi in the indicated mean effective pressures Pi is below the predetermined level, step S8 decrementally adjusts the incremental correction coefficient $K_{TW}$ for the present cooling water temperature Tw by a predetermined value $\Delta K_{TW1}$, to decrease the quantity of fuel to be injected. The adjusted coefficient $K_{TW}$ is set as data for the present cooling water temperature Tw, and the map of correction coefficients $K_{TW}$ set depending on cooling water temperatures Tw is updated.

As mentioned above, the proportion of the fuel injected from the fuel injector 6 that adheres around the intake valve and causes a wall flow increases as the temperature of the engine falls. At this time, the incremental correction coefficient $K_{TW}$ is set to prevent the leaning of the air-fuel ratio due to the increase of wall flow. An initial valve of the incremental correction coefficient $K_{TW}$ is determined according to the heaviest fuel that hardly evaporates among fuels expected to be used with the engine.

When the characteristics of the fuel presently used change, the adhesion ratio and evaporation ratio of the wall flow change to change a required incremental correction level. If the incremental correction level is below the required level, the air-fuel ratio becomes lean to cause misfire and surge. If the incremental correction level is greater than the required level, the surge will not occur, but the useless increase raises fuel consumption and deteriorates exhaust quality.

Accordingly, the embodiment of the present invention detects a shortage or an excess in the temperature-based incremental correction level according to the ΔPi indicating a change in the engine output. $K_{TW}$ the present invention adjusts the incremental correction coefficient $K_{TW}$ based on the water temperature Tw, to bring the ΔPi close to the predetermined value, i.e., the allowable surge level. This technique surely prevents surge exceeding the allowable level, in consideration of variously required incremental correction levels that differ from fuel to fuel, without uselessly increasing the fuel supply quantity.

The incremental correction coefficient $K_{TW}$ can be optimized with use of the cylinder internal pressure sensor 16 arranged for detecting misfire and knocking states. Namely, there is no need to arrange a separate fuel characteristic sensor when optimizing the incremental correction coefficient $K_{TW}$ according to a change in the characteristics of fuel used. This helps suppress the cost of the engine. Surge is accurately detectable according to an integral value of the cylinder internal pressures P, with no influence of noise.

According to this embodiment, the predetermined values $\Delta K_{TW1}$ and $\Delta K_{TW2}$ (correction values) used for incrementally and decrementally adjusting the incremental correction coefficient $K_{TW}$ are set as $\Delta K_{TW1} < \Delta K_{TW2}$. As a result, surge due to a shortage in the incremental correction level is promptly prevented by increasing the incremental correction coefficient $K_{TW}$ in large steps. When surge smaller than an allowable level is caused, the correction coefficient $K_{TW}$ is gradually reduced in small steps, to bring the incremental correction coefficient $K_{TW}$ close to a required minimum.

If the change ΔPi exceeds the predetermined value after the gradual decrease of the incremental correction coefficient $K_{TW}$, the level of the incremental correction coefficient $K_{TW}$ just before the change ΔPi exceeds the predetermined value is learned and continuously used until the fuel used is changed to another.

After the incremental correction coefficient $K_{TW}$ is adjusted according to the characteristics of the fuel used, step S9 finds a deviation of an initial value $K_{TW}\phi$ of the incremental correction coefficient $K_{TW}$ based on the present cooling water temperature Tw from the adjusted correction coefficient $K_{TW}$. The deviation is set as $\Delta K_{TW}(\rightarrow K_{TW}\phi - K_{TW})$. The initial value $K_{TW}\phi$ is determined according to the heaviest fuel that hardly evaporates and corresponds to a reference incremental correction level.

The initial value $K_{TW}\phi$ is determined according to the heaviest fuel that hardly evaporates as mentioned above. When easily evaporative fuel is employed, a required incremental level based on the incremental correction coefficient $K_{TW}$ becomes smaller. Namely, the larger the deviation $\Delta K_{TW}$, the easier the fuel evaporates.

Step S10 adjusts, according to the deviation $\Delta K_{TW}$, initial values KACCϕ and KDECϕ for an incremental correction coefficient KACC for incrementally correcting the supply of fuel during acceleration and a decremental correction coefficient KDEC for decrementally correcting the supply of fuel during deceleration.

The initial values for the coefficients KACC and KDEC are set according to the heaviest fuel that hardly evaporates. When the $\Delta K_{TW}$ is large and the fuel presently used easily evaporates, the required incremental level for acceleration is small, and the required decremental level for deceleration is also small.

Accordingly, the initial values KACCϕ and KDECϕ for the incremental correction coefficient KACC for acceleration and decremental correction coefficient KDEC for deceleration are decreased as the deviation $\Delta K_{TW}$ for deceleration are decreasingly adjusted as the deviation $\Delta K_{TW}$ becomes larger. The adjusted coefficients are used for calculating the fuel injection pulse width Ti.

The calculation of the fuel injection pulse width Ti carried out in step S11 will be explained.

A base pulse width Tp is calculated according to the intake air quantity Q detected by the airflow meter 13 and the engine speed Ne calculated according to the detection signal from the crank angle sensor 14. The incremental correction coefficient $K_{TW}$ and the incremental and decremental correction coefficients KACC and KDEC adjusted in the step S10 are used to form a correction coefficient COEF ($=1+K_{TW}+KACC-KDEC \ldots$).

A correction portion Ts is added to correct a change in the effective valve open time of the fuel injector 6 due to a battery voltage. The base pulse width Tp is adjusted according to the correction coefficient COEF and voltage correction portion Ts, and the final fuel injection pulse width Ti ($=Tp \times COEF + Ts$) is calculated.

In the above embodiment, a change in the engine output due to a change in the fuel characteristics is detected as a change in the indicated mean effective pressure Pi obtained from the cylinder internal pressure P. Instead, the change in the engine output may be detected according to a change in an engine speed. Even if there is no pressure sensor 16, the crank angle sensor 14 is usually provided to measure the engine speed that is essential for electronically controlling fuel injection. Accordingly, detecting a change in the engine output according to a change in the engine speed will be more general-purpose.

As disclosed in Japanese Unexamined Patent Publication No. 1-216040, it is possible to arrange a sensor for directly detecting the characteristics (the evaporative characteristics) of fuel according to the electrostatic capacitance of the fuel. The fuel characteristics are used as the parameter correlated to the instability of engine combustion. According to the detected fuel characteristics, the incremental correction coefficient $K_{TW}$ is adjusted, and according to the degree of adjustment on the initial incremental correction coefficient, the incremental correction coefficient KACC and decremental correction coefficient KDEC are adjusted. In this case, step SA is carried out instead of the steps 1 to 8, as indicated with dotted lines in FIG. 3.

Figure 4:
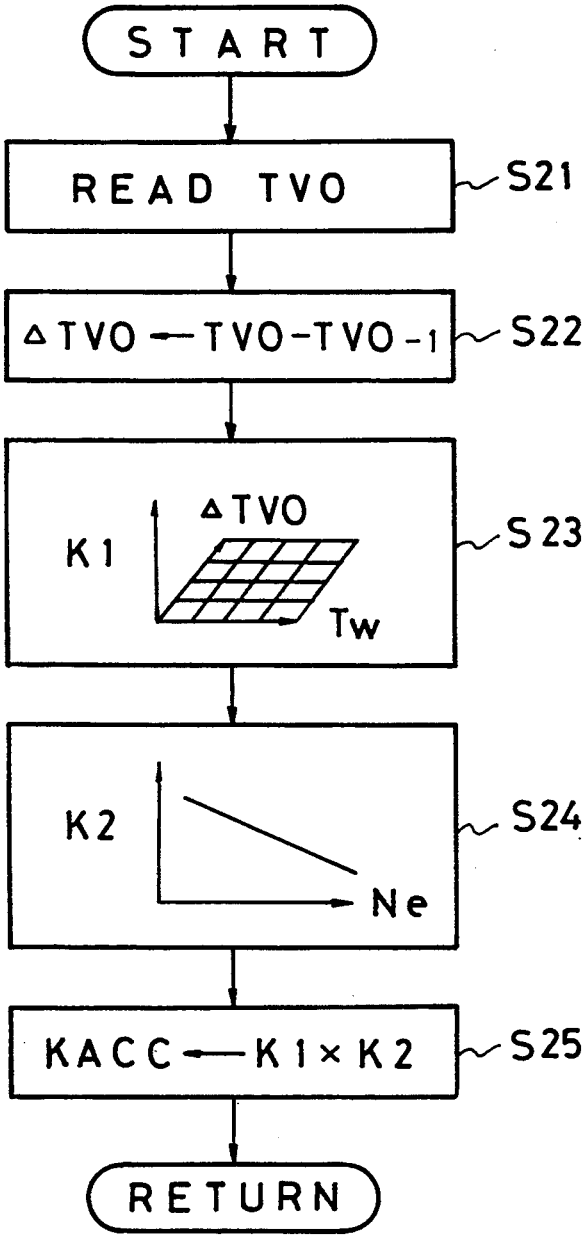
FIG. 4 is a flowchart of steps of setting and controlling an acceleration-based incremental correction coefficient.
Figure 5:
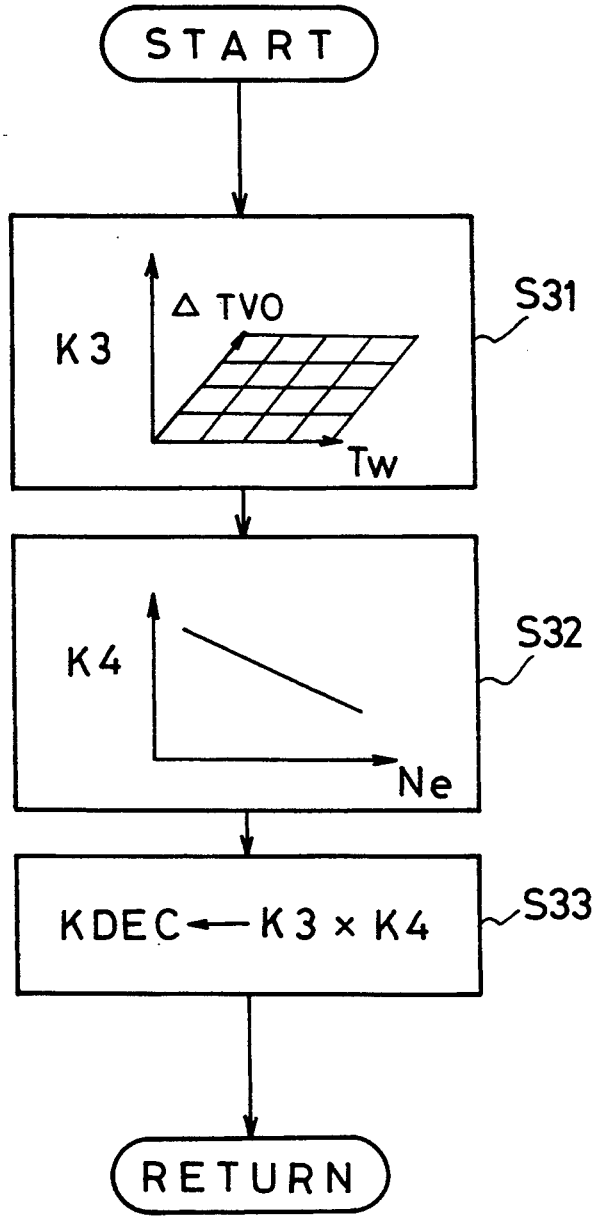
FIG. 5 is a flowchart of steps of setting and controlling a deceleration-based decremental correction coefficient.

The incremental and decremental correction coefficients KACC and KDEC are set according to acceleration or deceleration of the engine 1, as shown in FIGS. 4 and 5.

FIG. 4 shows a flowchart of steps of setting and controlling the incremental correction coefficient KACC for acceleration. Step S21 reads the throttle valve opening TVO detected by the throttle sensor 17.

Step S22 calculates a rate of change in the opening, i.e., a deviation ΔTVO of the opening TVO read in the step S21 from an opening $TVO_{-1}$ read in the preceding process.

Step S23 refers to a map storing incremental coefficients K1 according to water temperatures and incremental coefficients for rates of change in the opening, to find an incremental coefficient K1 corresponding to the present rate of change ΔTVO and water temperature Tw.

Step S24 refers to a map storing incremental coefficients K2 according to engine speeds, to find an incremental coefficient K2 for the present engine speed Ne.

Step 25 multiplies the incremental coefficient K1 by the incremental coefficient K2, to provide the incremental correction coefficient KACC.

FIG. 5 is a flowchart showing steps of setting and controlling the decremental correction coefficient KDEC for deceleration. Similar to the step S23, step S31 refers to a map storing decremental coefficients K3 according to water temperatures and decremental coefficients for rates of change in the opening, to find a decremental coefficient K3 corresponding to the present rate of change ΔTVO and water temperature Tw.

Step S32 refers to a map storing decremental coefficients K4 according to engine speeds, to find a decremental coefficient K4 corresponding to the present engine speed Ne.

Step S33 multiplies the decremental coefficient K3 by the decremental coefficient K4, to provide the decremental correction coefficient KDEC for deceleration.

We claim:

1. An apparatus for controlling the quantity of fuel supplied to an internal combustion engine, comprising:

engine temperature detection means for detecting the temperature of the engine;

temperature-based incremental correction means for incrementally correcting the quantity of the fuel supplied by fuel supply means to the engine, according to the detected engine temperature;

transient operation detection means for detecting acceleration or deceleration in the engine;

transient-operation-based correction means for incrementally or decrementally correcting the quantity of the fuel supplied by the fuel supply means to the engine, according to the detected acceleration or deceleration;

combustion state detection means for detecting a parameter correlated to the instability of engine combustion;

incremental correction level adjust means for adjusting an incremental correction level provided by the temperature-based incremental correction means, according to the detected parameter; and transient-operation-based correction level adjust means for adjusting a correction level provided by the transient-operation-based correction means, according to the degree of adjustment done by the incremental correction level adjust means on a reference incremental correction level.

2. The apparatus according to claim 1, wherein the combustion state detection means detects a cylinder internal pressure of the engine as the parameter correlated to the instability of engine combustion.

3. The apparatus according to claim 2, wherein the incremental correction level adjust means integrates cylinder internal pressures for a predetermined integral period and adjusts the incremental correction level provided by the temperature-based incremental correction means such that a change in the integration result comes closer to a predetermined value.

4. The apparatus according to claim 1, wherein the combustion state detection means detects the evaporative characteristics of the fuel as the parameter correlated to the instability of engine combustion.

5. The apparatus according to claim 1, wherein the transient operation detection means detects a rate of change in the opening of a throttle valve arranged in an intake system of the engine.

6. The apparatus according to claim 1, wherein the transient-operation-based correction level adjust means decreases the correction level provided by the transient-operation-based correction means as the incremental correction level adjust means further decreases the incremental correction level provided by the temperature-based incremental correction means with respect to the reference incremental correction level.

7. A method of controlling the quantity of fuel supplied to an internal combustion engine, comprising the steps of:

detecting the temperature of the engine;

incrementally correcting the quantity of the fuel supplied by fuel supply means to the engine, according to the detected engine temperature;

detecting acceleration or deceleration in the engine;

incrementally or decrementally correcting the quantity of the fuel supplied by the fuel supply means to the engine, according to the detected acceleration or deceleration;

detecting a parameter correlated to the instability of engine combustion;

adjusting an incremental correction level provided by the step of incrementally correcting the fuel quantity according to the detected engine temperature, according to the detected parameter; and adjusting a correction level provided by the step of correcting the fuel quantity according to the detected acceleration or deceleration, according to the degree of the adjustment done on the incremental correction level.

8. The method according to claim 7, wherein the step of detecting the parameter correlated to the instability of engine combustion detects a cylinder internal pressure of the engine as the parameter.

9. The method according to claim 8, wherein the step of adjusting the incremental correction level involves the steps of:

integrating cylinder internal pressures for a predetermined integral period; and adjusting the incremental correction level such that a change in the integration result comes closer to a predetermined value.

10. The method according to claim 7, wherein the step of detecting the parameter correlated to the instability of engine combustion detects the evaporative characteristics of the fuel as the parameter.

11. The method according to claim 7, wherein the step of detecting acceleration or deceleration in the engine detects a rate of change in the opening of a throttle valve arranged in an intake system of the engine.

12. The method according to claim 7, wherein the correction level based on the acceleration or deceleration is decreased as the incremental correction level based on the engine temperature is further decreased with respect to a reference incremental correction level.

* * * * *